US005941800A

United States Patent [19]

Laconis

[11] Patent Number: 5,941,800

[45] Date of Patent: Aug. 24, 1999

[54] REHABILITATION EXERCISE MACHINE

[75] Inventor: Gregory E. Laconis, Houston, Tex.

[73] Assignee: Total Motion, Inc., Houston, Tex.

[21] Appl. No.: 08/914,906

[22] Filed: Aug. 18, 1997

Related U.S. Application Data

[63] Continuation-in-part of application No. 08/625,755, Mar. 29, 1996, abandoned.

[51] Int. Cl.[6] ..... A63B 23/035

[52] U.S. Cl. ..... 482/70; 482/51; 601/23

[58] Field of Search ..... 601/23, 33–35, 601/27, 29, 31; 482/51–53, 70, 71, 67, 907, 908, 111; 434/255

[56] References Cited

U.S. PATENT DOCUMENTS

| | | | |
|---|---|---|---|
| 219,439 | 9/1879 | Blend | 601/23 |
| 0,326,247 | 9/1885 | Root . | |
| 2,210,269 | 8/1940 | Taylor | 601/23 |
| 2,772,881 | 12/1956 | Fundom . | |
| 2,969,060 | 1/1961 | Swanda et al. . | |
| 3,824,994 | 7/1974 | Soderberg, Sr. | 601/29 |
| 4,226,413 | 10/1980 | Daugherty | 482/67 |
| 4,529,194 | 7/1985 | Haaheim . | |
| 4,618,139 | 10/1986 | Haaheim . | |
| 4,632,385 | 12/1986 | Geraci . | |
| 4,645,200 | 2/1987 | Hix . | |
| 4,709,918 | 12/1987 | Grinblat . | |
| 4,949,954 | 8/1990 | Hix . | |
| 4,960,276 | 10/1990 | Feuer et al. . | |
| 5,000,442 | 3/1991 | Dalebout et al. . | |
| 5,098,085 | 3/1992 | Abboudi et al. | 482/70 |
| 5,162,029 | 11/1992 | Gerard | 482/71 |
| 5,181,894 | 1/1993 | Shieng . | |
| 5,387,168 | 2/1995 | Bostic | 482/70 |
| 5,573,480 | 11/1996 | Rodgers, Jr. . | |
| 5,637,060 | 6/1997 | De Souza | 482/70 |

FOREIGN PATENT DOCUMENTS

| | | | |
|---|---|---|---|
| 886915 | 12/1981 | U.S.S.R. | 482/71 |
| 2007987 | 5/1979 | United Kingdom . | |

*Primary Examiner*—Jeanne M. Clark
*Attorney, Agent, or Firm*—Mark R. Wisner

[57] ABSTRACT

The present invention provides an exercise machine having parallel ski bases on which skis are rollably or slidably engaged, the skis having foot restraints for receiving a user's feet. An upright ski pole is attached at an end to each ski using a pivot connection, and the ski pole is also pivotally connected to a fulcrum at a point near the midpoint of the ski pole. The fulcrum comprises a brace attached to a frame. The ski poles provide support to a user and are pushed and pulled for upper-body exercise. Where the user has little or no lower-body muscle control, the ski poles function as supports and levers to transfer a passive, reciprocating, back and forth motion to the user's legs. Alternatively, the exercise machine can be used for active exercise of both the upper and lower body. The exercise matching provides access for persons with physical handicaps and support for such users in the standing position, thereby allowing such persons to exercise while standing. For additional support of such users, a belly bar having a belt that the user can fix around his or her midbody is attached to the frame using adjustable members.

4 Claims, 3 Drawing Sheets

REHABILITATION EXERCISE MACHINE

CROSS REFERENCE TO RELATED APPLICATION

This application is a Continuation-in-Part of my application Ser. No. 08/625,755, filed Mar. 29, 1996 now abandoned.

BACKGROUND OF THE INVENTION

The present invention relates to exercise machines, particularly exercise machines for use by a person having little or no leg muscle control. A wheelchair-bound person should exercise the upper body. Passive movement of such a person's legs is beneficial in that the movement helps muscle tone and the circulatory system.

Various exercise devices have been disclosed for these purposes. U.S. Pat. No. 2,772,881 to Fundom provides an exercise device for elderly and handicapped persons. The Fundom device provides a pair of pedals that can slide along a base, much like cross-country skiing. The Fundom device includes arms that are mechanically connected to the pedals so that the force provided by arm muscles can assist leg muscles in sliding a pedal along a base. Users of the Fundom device are seated at the machine.

U.S. Pat. No. 4,645,200 to Hix provides an exercise device for elderly and handicapped persons having J-shaped pedal bars pivotally mounted to a frame. Like the Fundom device, a user of the Hix device is seated. The pedal bars terminate in foot pedals extending perpendicularly outwardly from the pedal bars and move in a substantially linear back-and-forth type motion. The J-shaped bars have a cord fastened to them which is engaged with a pulley so that the bars provide an opposing to-and-fro motion. Pedals are attached to a lower end of the J-shaped bars and follow the to-and-fro motion. A seated user places his or her feet on the pedals and hands on handles located on upper ends of the J-shaped bars. Force exerted by a single foot or hand provides movement of the other extremities.

A second Hix patent, U.S. Pat. No. 4,949,954, describes a jointed bicycle-simulation device for isometric exercise. This device is said to be for use by convalescing and handicapped persons, also, and has foot pedals and hand grips which all swing in an orderly fashion so as to not place undue strain on the user's joints. The lower end of a first upwardly inclined leg-activated bar is pivotally connected to the lower end of a first upwardly inclined arm-activated bar. Adjacent these bars, second leg-activated and arm-activated activated bars are identically coupled. The two pivot points of the bar are attached to opposed ends of an elastomeric band which is engaged with a pulley. A rod can be inserted into the pulley to provide a resistance to movement of the bars, while with the rod removed from the pulley, the pulley is allowed to rotate relatively freely.

U.S. Pat. No. 4,960,276 to Feuer, et al. describes a cross country ski exercise apparatus which includes a platform on which right and left foot engaging supports are disposed for reciprocal sliding movement with right and left hand engaging members being operatively connected to the foot engaging supports to reciprocate in a pattern simulating cross country skiing. The Feuer, et al. device provides a pair of identical hand-engaging members in the form of simulated ski poles disposed for reciprocating movement in linear slots.

U.S. Pat. No. 5,000,442 to Dalebout, et al. describes a cross country ski exerciser having an upright member and an extension member which are structured to move between a first upright configuration and a second configuration in which they are collapsed. The main member is positioned substantially between the parallel tracks of the cross country ski exercise machine.

The rehabilitation exercise machine of the present invention was developed for the purposes of exercising or rehabilitating paraplegic individuals or any person with some kind of standing impairment. There are several unique characteristics of this rehabilitation exerciser machine which include parallel bars, a belly bar, poles that move the legs using muscular effort exerted by the arms and upper body, U-shaped (concave downward) troughs in which foot plates slide enabling less height of the foot plates and easier access by the user, and the capability of alternatively placing the machine in water such as a shallow portion of a swimming pool to take advantage of buoyancy and water resistance to movement. In this embodiment, the exerciser and its appurtenances may be configured with baffles and fins to replace the tension pulleys and cable that provide resistance in the "dry" version of the exerciser. On information and belief, no exerciser of this kind is presently available that assists a person with such impairments to stand independently and exercise his or her arms, hips, and legs simultaneously either in or out of the water.

It is therefore an object of the present invention to provide an exerciser which enables a mostly wheelchair bound person to independently mount the exerciser by using the adjustable parallel bars which can be alternatively configured with flared or widened ends to facilitate access. The person can grasp the bars and pull himself up to a standing position. Once in a standing position the person uses the parallel bars to aid himself in setting his legs onto the foot plates.

By grasping and holding onto the arm poles and pushing them back and forth, he is now able to start exercising his total body. By stabilizing the mid section of the person, by having arm poles that move the person's legs back and forth, and with the development of mounted parallel bars, the rehabilitation exerciser machine of the present invention is easy to use independently and is believed uniquely set apart from any other of its kind.

The foot plates may be detachable from the operating positions used in actual exercise and moved to the rear of the exerciser to facilitate easier access by the user. After engaging the foot plates or alternatively moving forward on the hand rails and then placing his feet in the foot plates, the user then stabilizes himself by holding onto the parallel bar with one hand while wrapping his mid section to the belly bar with a hook and pile belly belt.

Alternatively, the user may put on a seat harness before accessing the exerciser, moving forward as previously described and attaching hooks on the seat harness to the belly bar.

In an alternative embodiment, the seat harness may be attached to an overhead crane or rail with a sliding fitting so that the user may be elevated in a vertical stance, moved into position and lowered into the exerciser until his foot makes contact with the foot plates and/or fittings mounted to leg braces the user has strapped on each leg make contact with pivot grooves attached to the foot plates.

In an alternate embodiment, the leg braces worn by the user to improve lower limb rigidity, may be pivotably attached or attachable to the foot plates so that the user may either put on the leg braces, mount the foot plates and then attach the braces to the foot plates or move his legs into the open braces already attached to the foot plates, strap them around his legs and then grasp the hand rails move forward into position and begin exercising.

In another embodiment, the poles impelled by arm motion may be mounted with a variable pivot whereby the user may choose to trade mechanical advantage for arm movement and lesser overall movement of the footplates with lesser mechanical advantage and correspondingly greater movement of the feet and legs as driven by arm movement. This is accomplished by varying the height of the pivot around which each driving pole rotates. As the pivot is moved up, the portion of the pole above the pivot shortens so that arms and shoulders must exert more force to achieve the same torque. Concomitantly, the portion of the pole below the pivot is elongated thus driving the feet and legs in a greater arc.

The exerciser may optionally feature monitoring means for measuring and recording parameters such as number of repetitions, rate of work performed, amount of work performed and/or user's heart rate.

An alternative embodiment of the exerciser may include a motor drive with variable speed and intermittent features to provide movement and stimulate muscles and circulation for those without sufficient arm strength to propel the motion of the device. The motor drive may be engaged at variable speeds to power the whole movement cycle or employed to provide impulses at the end of a cycle.

Another object of the present invention is to provide a rehabilitation exercise machine which allows a person to be in a standing position while getting a full body workout. While using the rehabilitation exerciser of the present invention, a person, such as a paraplegic individual with leg braces, can utilize his shoulders and arms to gain strength and muscle tone. Most importantly, while standing, the legs are moving back and forth putting them into an important walking motion. The exerciser of the present invention therefore benefits the total body by providing a cardiovascular workout, stretching leg muscles, and improving the circulation throughout the entire body.

Another object of the present invention is to provide a rehabilitation exerciser which is versatile enough that anyone can use it for the purposes of exercising. It can be used in a hospital or home environment for regaining muscle control and walking ability by patients recovering from a stroke, hip replacement, or multiple sclerosis. Therefore, the exercise machine of the present invention offers use as a general rehabilitation tool as well as a full body workout for a person with a permanent walking impairment.

Yet another object of the present invention is to provide a rehabilitation exercise machine which is a very beneficial device for persons with walking or standing disabilities in that it enables such a person independent use and total body movement which is currently not believed available with any other piece of equipment.

On information and belief, because the cross country ski exercise machines described in the patents above do not provide vertical support or stability for a user, there remains a need for an exercise machine for convalescing and handicapped persons that can be used while in the standing position. Therefore, it is another object of the present invention to provide a rehabilitation exercise machine which can be accessed by a person from a wheelchair and yet be used from a standing position because of the vertical support and/or stability provided for a user by ski poles which are themselves supported in a vertical position. A further object of the invention is to provide passive motion for the user's legs, which is derived from force exerted by the user's upper body.

SUMMARY OF THE INVENTION

These, and the many other objects of the present invention which will be apparent to those skilled in the art from the following detailed description of a presently preferred embodiment thereof, are achieved by providing an exercise machine comprising skis rollably engaged with ski bases and ski poles, each pivotally connected to a fulcrum along its length and pivotally connected to a ski at an end, so that a user can support him or herself with the ski poles while pushing and pulling on the ski poles for upper-body exercise, which provides passive motion to the lower body.

In one aspect, the present invention achieves these many objects by providing an exercise machine comprising first and second substantially parallel ski bases, first and second skis slidably engaged with said respective first and second ski bases, first and second elongate ski poles, each of said first and second ski poles having one end pivotally connected to the respective first and second skis; and first and second braces secured to the respective first and second ski bases having the respective first and second ski poles pivotally connected thereto at a point between the ends of the respective first and second ski poles. A belly bar is preferably secured to said first and second ski bases for supporting a user of said exercise machine, said belly bar preferably having an adjustable member for providing means to adjust said belly bar.

DETAILED DESCRIPTION OF THE INVENTION

Figure 1:
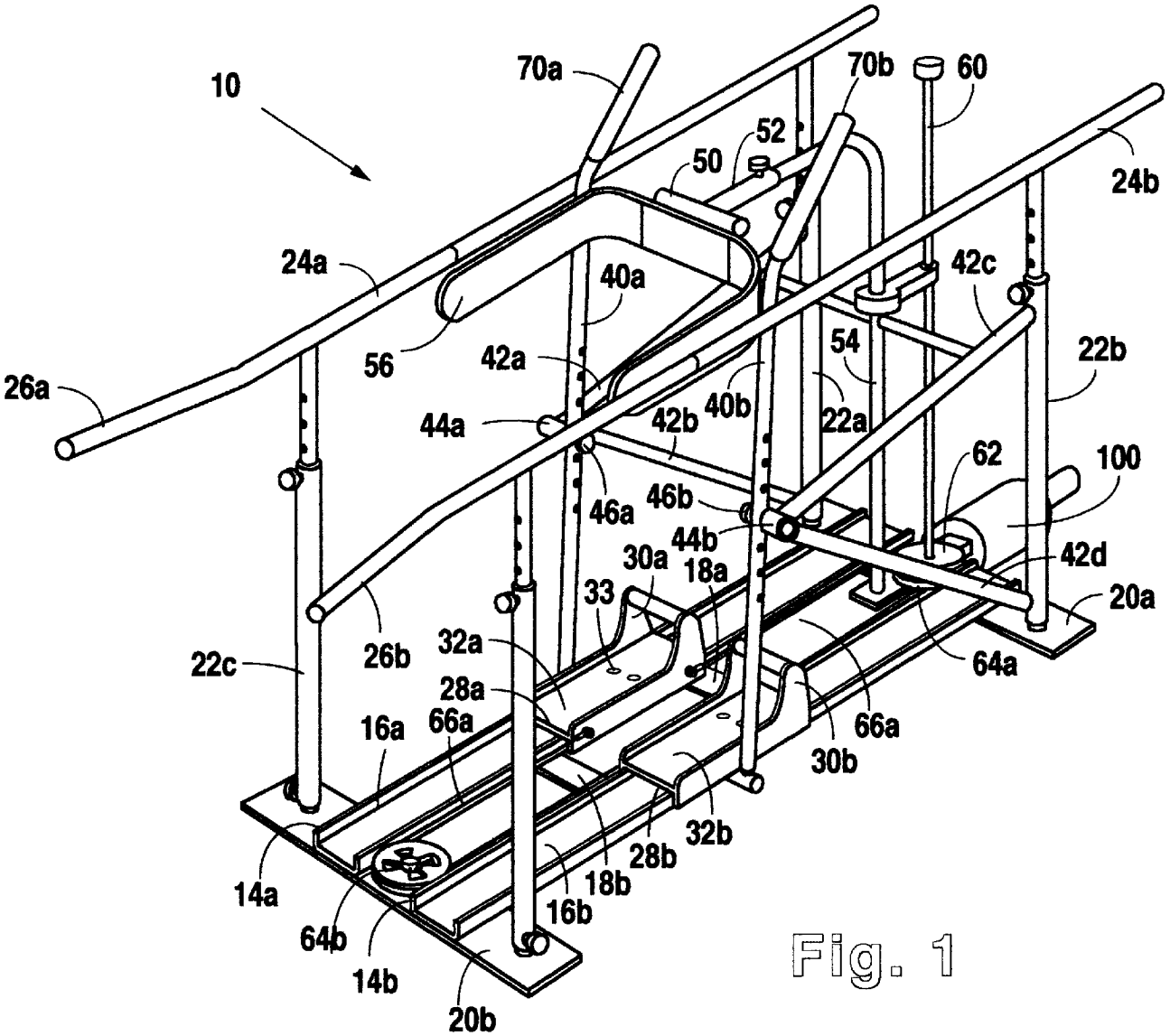
FIG. 1 is a perspective view of an exercise machine according to one embodiment of the invention.
Figure 1A:
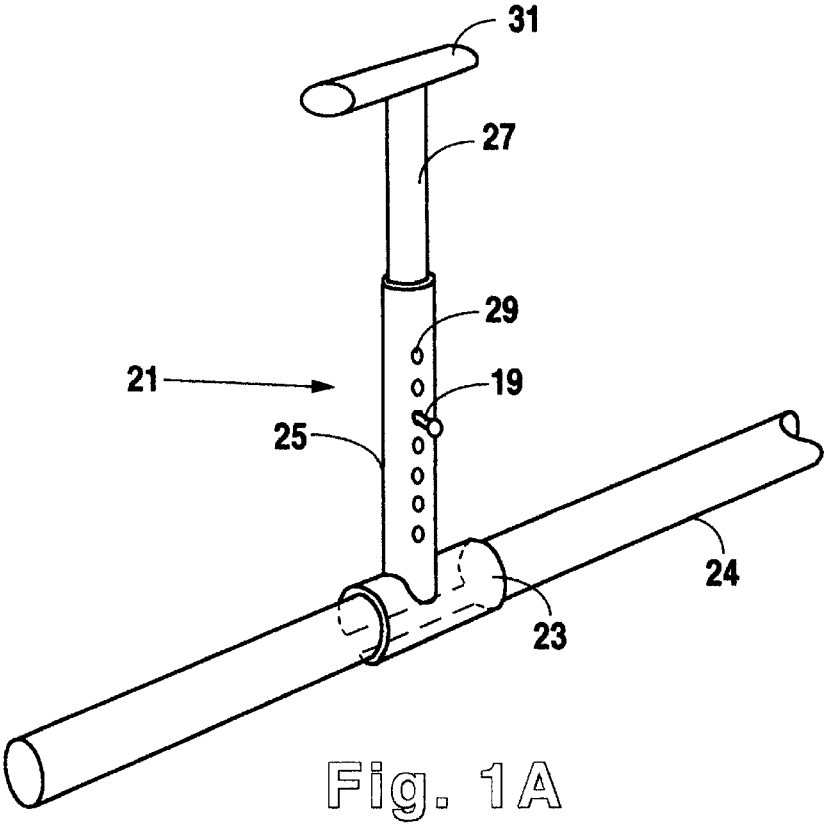
FIG. 1A is a drawing of a portion of the parallel bars of the apparatus of the present invention showing a vertical support constructed in accordance with teachings of the present invention.
Figure 1B:
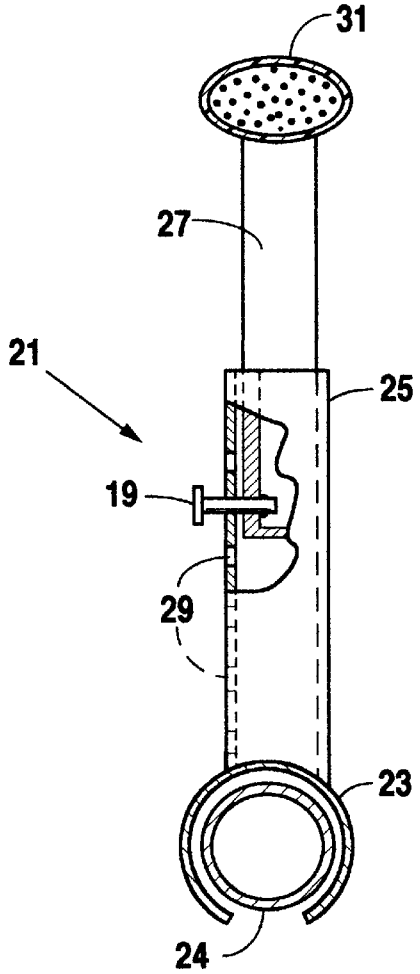
FIG. 1B is and end view of the support member of FIG. 1A.
Figure 2:
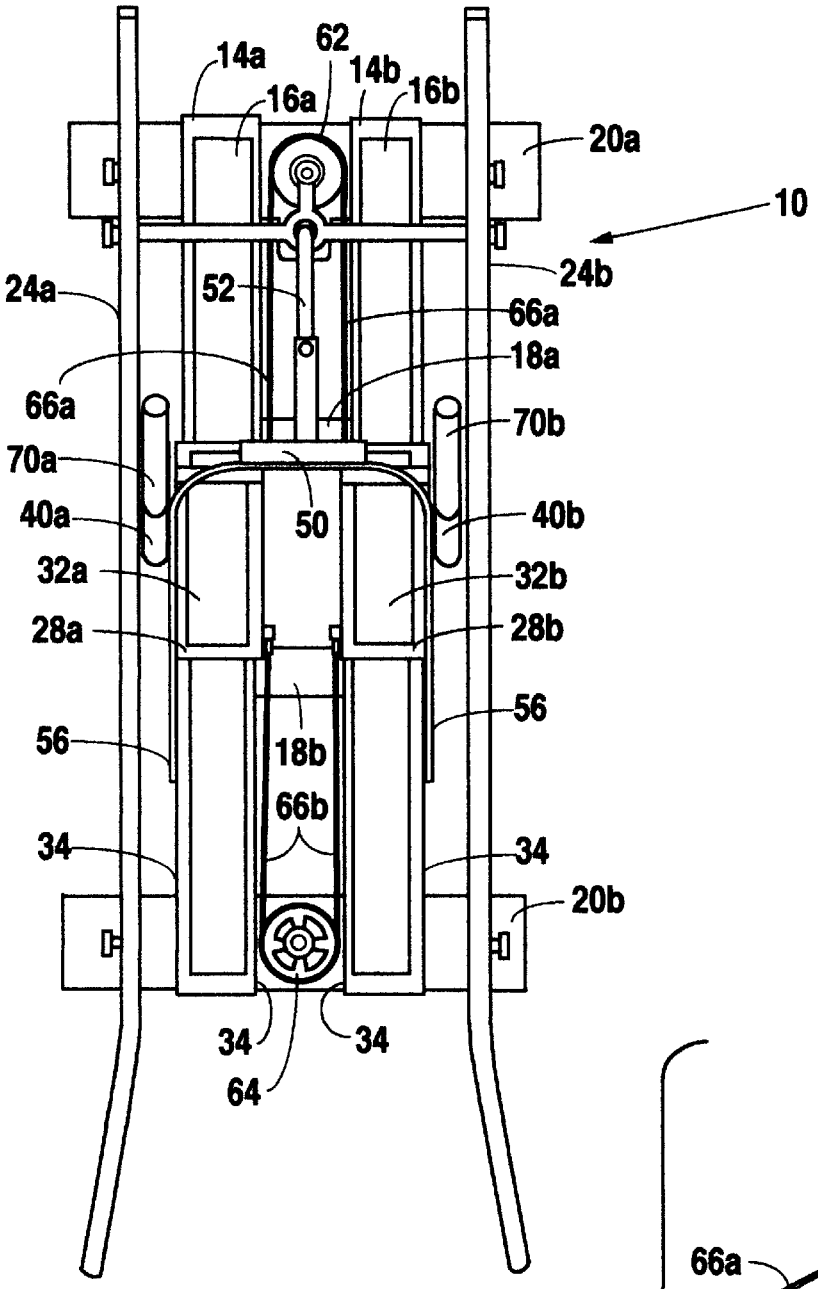
FIG. 2 is a plan view of the exercise machine of FIG. 1.

With reference to FIGS. 1 and 2 where like parts are identified by a like numeric identifier, a rehabilitation exercise machine 10 comprises two substantially parallel left and right ski bases 14*a* and 14*b*, respectively, which are covered with anti-skid pads 16*a* and 16*b* and held substantially parallel by two ski base stabilizer bars 18*a* and 18*b*. (Letter suffixes are used to differentiate similar elements having a common numeric identifier and general reference will be made to similar elements using only the numeric identifier, for example, left and right ski bases 14*a* and 14*b* may be referred to as ski bases 14.) The ski bases 14*a* and 14*b* are attached to front and rear base plates 20*a* and 20*b*, respectively. Two vertical poles 22*a* and 22*b* are removably secured in an upright position to the front base plate 20*a*, and two more vertical poles 22*c* and 22*d* are removably secured in an upright position to the rear base plate 20*b*. These four vertical poles removably support two parallel bars. The two vertical poles 22*a* and 22*c* on the left side of the machine removably support a left side parallel bar 24*a*, and the two vertical poles 22*b* and 22*d* on the right side of the machine removably support a right side parallel bar 24*b*. The parallel bars 24*a* and 24*b* have extensions 26*a* and 26*b*, respectively, in the rear for enabling a wheelchair-bound user to access the rehabilitation exercise machine 10. In one preferred embodiment, all of the parts comprising the exercise machine of the present invention are comprised of materials which are water resistant so that the entire machine can be submerged in water to increase the benefit of the exercise, to help support the body weight of a multiply-handicapped user, and or to utilize water resistance to motion as augmentation or substitution of the resistance means against the user performs work. To this end, another preferred embodiment of the invention includes baffles and fins (not shown) on moving members such as skis 28 and/or ski poles 40 to utilize water resistance as the inductor of work effort rather than a cable and pulley tension system.

In another preferred embodiment, the parallel bars 24*a* and 24*b* are flared outwardly so that the rear ends 26*a* and 26*b* are more widely supported than the front end. The vertical poles 22*c* and 22*d* are spread further apart than the vertical poles 22*a* and 22*b*. This set of features enables easier access to the machine by a user from a wheelchair.

In another preferred embodiment, a user worn seat harness (not shown) is attached to a cable (not shown) suspended from a gantry. The user or other may use controls on the gantry to elevate the user and move him into position on the machine.

The parallel bars are provided with first and second vertical user supports 21*a* and 21*b*, slidably and rotatably connected to the parallel bars 24; said vertical supports for these comprising a first and second sleeve 23*a* and 23*b* slidably received over said respective parallel bars 24*a* and 24*b*. Sleeves 23*a* and 23*b* are provided with integral tubular members 25*a* and 25*b* extending at an angle from said sleeves and receiving first and second elongate member 27*a* and 27*b* therein. Both elongate members 27 and tubular members 25 are provided with a plurality of matching, spaced holes 29*a* and 29*b* receiving pins 19*a* and 19*b* for adjusting the overall length of said vertical supports. Elongate members 27 are provided with padded support members 31*a* and 31*b*. Users may optimally arrange the vertical members with the padded members on the ends of the tubular members under each axilla for additional support in moving an end of the machine.

A left ski 28*a* is slidably or rollably mounted to the left ski base 14*a*, and a right ski 28*b* is slidably or rollably mounted to the right ski base 14*b*. A left foot restraint 30*a* is secured to the left ski 28*a*, and a right foot restraint 30*b* is secured to the right ski 28*b*. Anti-slip pads 32*a* and 32*b* are secured to the left and right skis 28*a* and 28*b*, respectively. The long edges 34 of each ski base 14 are provided with U-shaped channels (not shown) which receive a ski roller (not shown) for slidably or rollably engaging the ski 28. Each ski 28 has four ski rollers (not shown), two on each side of a ski 28. Two ski rollers on each side of a ski 28 slide or roll within the U-shaped channel on each long edge of a ski base 14. The U-shaped channels function as tracks or keepers for the skis 28 since the ski rollers are positioned within the U-shaped channel. A ski 28 is mounted onto a ski base 14 by sliding it on from an end of a ski base. A ski roller rolls or slides along a bottom inside edge of a U-shaped channel. A top inside edge of the U-shaped channel prevents demounting or disengaging of a ski 28 from a respective ski base 14 in a direction transverse to the length of the ski base 14. A ski 28 slides or rolls freely on a ski base 14 but is engaged with it by interlocking of the ski rollers with the U-shaped channels. As shown in FIG. 1, the ski bases 14*a* and 14*b* are comprised of U-shaped channel members having the open side of each channel upwardly such that channel members are referred to as being concave downward to lower the height of the skis 28 mounted thereon to assist the user in mounting the skis 28.

In one embodiment (not shown) the skis may be detached from the ski poles 40 and cables 66. After detachment the skis may be slid to the rear 14 of the ski basis for easier access by the user. After the user has engaged his feet on the ski bases, they may be slid forward and re-engaged with the ski poles.

A left ski pole 40*a* is pivotally connected to a left ski 28*a* on an outside edge of the left ski 28*a* which is away from the right ski 28*b*. Similarly, a right ski pole 40*b* is pivotally connected to a right ski 28*b* on an outside edge of the right ski 28*b* which is away from the left ski 28*a*. A left brace comprises members 42*a* and 42*b* having ends that connect to the left vertical pole 22*a* and opposing ends that intersect. Where the left brace members 42*a* and 42*b* intersect at ends opposite the left vertical pole 22*a*, a left brace pivot bushing 44*a* is fixed. The pivot bushing 44*a* has a hole (not shown) for receiving a pivot bolt or pin (not shown). Similarly, a right brace comprises members 42*c* and 42*d* having ends that connect to the right vertical pole 22*b* and opposing ends that intersect. Where the right brace members 42*c* and 42*d* intersect at ends opposite the right vertical pole 22*b*, a right brace pivot bushing 44*b* is fixed. The pivot bushing 44*b* has a hole (not shown) for receiving a pivot bolt or pin (not shown).

The left ski pole 40*a* is pivotally connected to the left brace pivot bushing 44*a* by a pivot bolt or pin (not shown) at a left pivot point 46*a*. Similarly, the right ski pole 40*b* is pivotally connected to the right brace pivot bushing 44*b* by a pivot bolt or pin (not shown) at a right pivot point 46*b*. Thus, a ski pole 40 has two pivotal connections, one to its respective ski 28 and another to its respective brace pivot bushing 44. In the present invention, the ski poles 40*a* and 40*b* provide a user with vertical and lateral support, support which is believed not to be provided in the cross-country ski exercise machines discussed above. The present invention is believed unique in that the ski pole 40 is supported by pivotal connection to a brace pivot bushing 44 at a point along its length, i.e. between its opposing ends. In the absence of the central pivot connections 46, a vertical force applied to a ski pole 40 would nearly always result in a horizontal movement of a ski 28. But with the central pivot connections 46, a vertical force applied to a ski pole 40 is much less likely to result in a horizontal movement of a ski 28. Thus, a convalescing or handicapped user can support him or herself while exercising with the present invention.

The left and right ski poles 40*a* and 40*b* can more aptly be called ski pole levers because they function as levers rather than merely as ski poles. The braces 42 and the pivot bushings 44 serve as fulcrums for the ski pole levers 40. The pivotal connections at the pivot points 46 are fulcrum points. A typical ski pole used in real cross-country skiing has a compressive force applied along its length by a user pushing the ski pole down onto the ground. The ski poles 40 of the present invention are pushed and pulled laterally so that each ski pole functions as a lever about a fulcrum. In addition, a user applies a compressive force to the ski poles 40 of the present invention as he or she supports and balances him or herself. Thus, a more complex array of forces are thought to be applied to the ski poles 40 of the present invention than are applied to real ski poles used in real cross-country skiing.

To accommodate users of different heights and/or physical abilities, the exercise machine of the present invention is provided with means for varying the height of the point at which the ski poles 40 are pivotally mounted to the braces 42. In the preferred embodiment, this pivot height varying means takes the form of a plurality of holes along the length of ski poles 40*a* and 40*b* for receiving a pivot bolt or pin (not shown) rotatably connecting the ski poles to the left and right pivot points 46*a* and 46*b*. The ability to vary the height of the ski pole pivot point enables the user to vary the mechanical advantage in the portion of the ski pole above the pivot point and with increasing height, to elongate the movement of the foot pieces driven by the ski poles.

In another preferred embodiment, the skis may be optimally provided with means for pivotally attaching a user's leg braces thereto. In one embodiment the leg brace attaching means comprises pivots 33 on the skis for pivotally attaching the leg braces thereto. For those patients who do not routinely wear leg braces, another preferred embodiment is provided with leg braces already pivotally attached (not shown) to the skis 32 which may be attached to the user's legs as he enters the machine.

Further support against lateral movement is provided to a user by a belly bar 50 having an adjustable horizontal section 52 and an adjustable vertical section 54, which is removably attached to the front base plate 20*a*. A user straps him or herself to the belly bar 50 using a belly belt 56, which is attached to the belly bar 50. The belly belt 56 is typically fastened using a Velcro fastener or a belt buckle (neither fastener is shown).

The amount of force required to alternatingly slide or roll the skis 28*a* and 28*b* is adjustable by a tension adjuster 60, which is rotated to adjust the compressive force applied to a pressure pad 62 which is in contact with a front pulley 64*a* that is rotatively secured to the front base plate 20*a*. As best seen in the exploded view of FIG. 3, the front pulley 64*a* is rotatively engaged with a front pulley shaft 65 which is secured to the front base plate 20*a*. A front cable 66*a* is operatively engaged with the front pulley 64*a* and secured at ends to the left and right skis 28*a* and 28*b*, respectively, as best seen in FIG. 2. Similarly, a rear cable 66*b* is operatively engaged with a rear pulley 64*b* and secured at ends to the left and right skis 28*a* and 28*b*, respectively. The length of travel of the skis 28 is proportional to the length of the cables 66. The cables 66 restrain the skis 28 from sliding or rolling off the ski bases 14.

Figure 3:
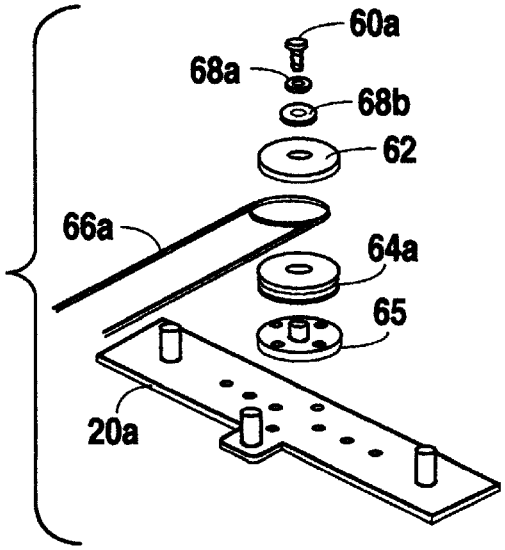
FIG. 3 is an exploded view of the pressure pad, front pulley, and related elements used to adjust tension.

With reference to FIG. 3, the pressure pad 62 rests upon the front pulley 64*a* creating friction therebetween. The tension adjuster 60 (not shown in FIG. 3) connects to a tension screw 60*a* which rests upon a first tension washer 68*a*. A second tension washer 68*b* engages the pressure pad 62, and a spring (not shown) is engaged between the first and second tension washers 68*a* and 68*b*, respectively.

Use of the rehabilitation exercise machine 10 will now be described. Where the user is confined to a wheelchair and has upper body muscle control, but little or no lower body muscle control, the user wheels up to the rear of the exercise machine 10. If the user has leg braces, these are locked into the straight position. Using the rear extensions 26*a* and 26*b* of the parallel bars 24*a* and 24*b*, the user hoists him or herself into an erect position. By alternatingly sliding his or her hands along the parallel bars, the user moves into contact with the belly bar 50 and swings his or her feet into the respective foot restraints 30*a* and 30*b*. With his or her legs in a locked, upright position, the user leans against the belly bar 50 and straps him or herself to the belly bar 50 with the belly belt 56. The belly belt 56 and belly bar 50 provide lateral support so that the user's legs do not buckle. In this manner, the user's legs provide vertical support.

With his or her left hand, the user grasps a left grip 70*a* on the left ski pole 40*a*. With his or her right hand, the user grasps a right grip 70*b* on the right ski pole 40*b*. The user uses the ski poles 40 to supplement the vertical and lateral support provided to his or her upper body by his or her legs. The pivot connection points 46 provide stability to the ski poles 40 so that they may be used by the user for holding him or herself in an upright position. The user normally operates the exercise machine 10 by alternatingly pushing and pulling the ski poles 40 with his or her hands and arms. The pivot connection points 46 provide fulcrum points for the ski poles 40, which are used as levers to slide or roll the skis 28 in a back and forth motion. The user exercises his or her upper body by alternatingly pushing and pulling the upper, hand-grip ends 70 of the ski poles 40. The user further exercises his or her upper body by using the ski poles for supplemental vertical and lateral support of his or her body. If necessary, the user can grasp the grip ends 70 of the ski poles 40, rest his or her forearms on the ski poles 40, which have a bend, and support his or her weight by holding onto the ski poles 40.

Pushing the left ski pole hand-grip end 70*a* forward causes the left ski 28*a* to roll or slide backward. Through the front and rear cables 66*a* and 66*b*, the right ski 28*b* is forced to roll or slide forward when the left ski 28*a* rolls backward. The right hand can provide an additive force by pulling on the right ski pole hand-grip end 70*b* while the left hand pushes on the left ski pole hand-grip end 70*a*. Alternatively, only pulling or only pushing motions can be used.

Throughout this discussion, the lower body has been presumed to remain passive. The user's lower body is passively exercised as his or her legs are moved back and forth as the skis roll back and forth due to the back and forth motion imparted by his or her hands to the ski pole hand-grip ends 70. The user can achieve a vigorous exercise workout for his or her upper body and, at the same time, passively exercise his or her lower body for improved muscle tone and cardiovascular performance. If the user is fortunate enough to have control of his or her legs, then the user can actively use his or her legs for a coordinated movement of the skis 28. In either case the exercise machine 10 provides a good workout for the user.

The force required to be exerted on the hand-grip ends 70 of the ski poles 40 to move the skis 28 can be manipulated by rotating the tension adjuster 60. By tightening the tension adjuster 60, the user applies greater compressive force on the pressure pad 62, which increases the friction between the pressure pad 62 and the front pulley 64*a*. The increased friction requires more energy input to the hand-grip ends 70 of the ski poles 40 for the same motion of the skis 28. Likewise, loosening the tension adjuster 60 decreases the energy requirement for the exercise machine 10.

The exercise machine of the present invention may be provided with means for outputting measurements related to the user of the machine, said measurements including user heart rate, repetitions of the motion, rate of work, total work, time of use, and calories consumed. These measurements may be provided to a display means for observation and/or recording.

The exercise machine of the present invention may be provided with a variable drive motor 100 whose output may be controlled to assist the driving action of the ski poles on the foot pieces.

For compactness while shipping or storing the exercise machine 10, it can be made with releasable connections for relatively simple assembly and disassembly. A user can benefit from exercising on the present invention, with or without muscle control of his or her lower body. The benefits include those typically derived from cardiovascular exercise.

The present invention is illustrated by way of the foregoing description, which is intended as a non-limiting illustration since many variations will become apparent to those skilled in the art in view thereof. It is intended that all such variations within the scope and spirit of the appended claims be embraced thereby.

What is claimed is:

1. An exercise machine comprising:

first and second substantially parallel ski bases;

first and second skis slidably engaged with said respective first and second ski bases;

first and second elongate ski poles, each of said first and second ski poles having one end pivotally connected to the respective first and second skis;

first and second braces secured to the respective first and second ski bases and having said respective first and second ski poles pivotally connected thereto at a point between the ends of said respective first and second ski poles; and means for varying the height of the point at which said first and second elongate ski poles are pivotally connected to said first and second braces.

2. The exercise machine of claim 1 constructed of water resistant material.

3. The exercise machine of claim 2 further comprising means for adjusting resistance to movement while submerged in water.

4. The exercise machine of claim 3 further comprising a variable drive motor for moving said skis along said ski bases, said variable drive motor operatively connected to said first and second ski bases.

* * * * *